US008966855B1

(12) United States Patent
Miller

(10) Patent No.: US 8,966,855 B1
(45) Date of Patent: Mar. 3, 2015

(54) FOUNDATION SYSTEM FOR MODULAR SYSTEM SMART BUILDINGS

(76) Inventor: Martin P. Miller, Anchorage, AK (US)

( * ) Notice: Subject to any disclaimer, the term of this patent is extended or adjusted under 35 U.S.C. 154(b) by 346 days.

(21) Appl. No.: 13/531,817

(22) Filed: Jun. 25, 2012

(51) Int. Cl.
*E04B 5/02* (2006.01)
*E02D 27/01* (2006.01)

(52) U.S. Cl.
USPC ..... 52/650.3

(58) Field of Classification Search
CPC ..... E04B 5/02; E04B 5/023; E04B 5/10; E04B 5/43; E04B 2001/24; E04B 2001/2484; E04F 15/02458; E04F 15/02447; E04F 15/02464; E04F 15/06; E02D 27/01
USPC ..... 52/126.5, 126.6, 126.1, 169.9, 650.3, 52/263, 741.11, 745.06, 741.15
See application file for complete search history.

(56) References Cited

U.S. PATENT DOCUMENTS

| | | | | |
|---|---|---|---|---|
| 3,878,662 | A * | 4/1975 | Cernosek | 52/745.18 |
| 3,977,536 | A * | 8/1976 | Moore et al. | 414/11 |
| 4,290,716 | A * | 9/1981 | Lamy | 405/203 |
| 4,788,809 | A * | 12/1988 | Koukourou | 52/741.15 |
| 4,870,789 | A * | 10/1989 | Clark et al. | 52/126.6 |
| 4,918,891 | A * | 4/1990 | Gerszewski | 52/295 |
| 4,930,270 | A * | 6/1990 | Bevacqua | 52/126.1 |
| 5,067,289 | A * | 11/1991 | Ouderkirk et al. | 52/169.11 |
| 5,595,366 | A * | 1/1997 | Cusimano et al. | 248/354.3 |
| 6,209,267 | B1 * | 4/2001 | Dantzer | 52/79.6 |
| 6,772,564 | B2 * | 8/2004 | Leon | 52/126.5 |
| 7,698,860 | B2 * | 4/2010 | Hockemeyer et al. | 52/263 |
| 7,707,780 | B2 * | 5/2010 | Ouellet et al. | 52/7 |
| 7,779,599 | B2 * | 8/2010 | Jolicoeur et al. | 52/650.3 |
| 8,011,148 | B2 * | 9/2011 | Bertke et al. | 52/263 |
| 8,256,172 | B2 * | 9/2012 | Benson | 52/220.1 |
| 8,295,035 | B2 * | 10/2012 | Collier | 361/678 |
| 8,490,234 | B2 * | 7/2013 | Rowell et al. | 14/2.4 |
| 2002/0092249 | A1 * | 7/2002 | Yin | 52/263 |
| 2003/0051420 | A1 * | 3/2003 | Leon | 52/126.6 |
| 2007/0175132 | A1 * | 8/2007 | Spransy et al. | 52/263 |
| 2008/0222976 | A1 * | 9/2008 | Liskey | 52/169.9 |
| 2009/0188189 | A1 * | 7/2009 | Repasky | 52/291 |
| 2010/0101179 | A1 * | 4/2010 | Cave | 52/741.11 |
| 2011/0102974 | A1 * | 5/2011 | Collier | 361/601 |
| 2011/0138736 | A1 * | 6/2011 | Brown | 52/741.11 |
| 2012/0304549 | A1 * | 12/2012 | Rutledge | 52/16 |

FOREIGN PATENT DOCUMENTS

| | | | | |
|---|---|---|---|---|
| WO | WO 9301379 A1 * | 1/1993 | | E04F 15/024 |

* cited by examiner

*Primary Examiner* — Christine T Cajilig
(74) *Attorney, Agent, or Firm* — Michael J. Tavella

(57) ABSTRACT

A modular structure foundation system that requires no heavy equipment, minimal site preparation, bag concrete and crushed rock, and can be easily assembled by a small crew. The foundation consists of a number of box bar joists that are square units which are assembled based on a grid layout. The box bar joists are supported by foundation steel columns that are embedded into the ground. No forms or other complex structures are needed for the installation. Once the columns are installed, the box bar joists are installed using a unique leveling system. Once the box bar joists are level and secured to the columns, the foundation is complete. The use of the box bar joists also allows for expansion or contraction as additional box bar joists can easily be added or removed from the foundation. Once the box bar joists are in place, the foundation is ready for building.

16 Claims, 18 Drawing Sheets

FOUNDATION SYSTEM FOR MODULAR SYSTEM SMART BUILDINGS

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to foundation systems and particularly to foundation systems for modular type construction.

2. Description of the Prior Art

Constructing shelters has been an essential part of human development since the beginning of civilization. In the last century, buildings have been developed beyond the ordinary "stick-frame" construction into new modular designs. Both types of construction, however, use the same types of foundation, which consists of a concrete footing and some type of concrete or block walls. The building is built upon these walls typically by bolting a bottom sill plate to the top of the foundation wall using "J" bolts that have been embedded in the concrete.

Although these walls have been proven to be strong and reliable, they require quite a lot of site preparation, including surveying, grading, excavating, rebar install, setting concrete forms, pouring concrete (or building wall of block), and then back filling around the foundation. Additionally, in many areas, the foundation wall is waterproofed, which adds additional costs and time.

BRIEF DESCRIPTION OF THE INVENTION

The instant invention eliminates all of the problems associated with conventional concrete type foundations. It consists of a modular structure that requires no heavy equipment, a fraction of construction time, minimal site preparation, bagged concrete, and can be easily assembled by a small crew. The foundation system is hurricane proof and tornado proof. It can be assembled and dismantled, for either emergency housing or permanent construction. It allows additions to be added at any time, simply and easily. Moreover, it allows parts of the building to be removed if desired. The foundation system allows an owner or contractor to build it quickly and easily.

The foundation consists of a number of box bar joists that are square units that are assembled based on a grid layout. The box bar joists are supported by foundation steel tube columns that are embedded into the ground. While installing the foundation columns does require bag concrete and crushed rock, no forms or other complex structures are needed for the installation. Once the columns are installed, the box bar joists are installed using a unique leveling system. Once the box bar joists are level and secured to the columns, the foundation is complete. The use of the box bar joists also allows for expansion or contraction as additional box bar joists can easily be added or removed from the foundation. Once the box bar joists are in place, the foundation is ready for building.

DETAILED DESCRIPTION OF THE INVENTION

The first step in the construction of the foundation is to prepare the site and lay out the grid. Referring now to FIGS. 1-4, the grid system 100 is shown. Prior to erecting the grid, it is good practice to ensure the site is surveyed by a licensed surveyor to confirm the location of all property lines. In the preferred embodiment, the best site is one that is nearly flat with no more than a six (6) inch rise (slope) from one side of the building exterior to the other in both directions, ensuring all the foundation poles are the same length; slopes greater than six inches will require longer foundation poles. As an alternative, the site can be graded prior to construction. In the next step, level any grade high points greater than six inches or fill areas lower than six inches with crushed rock or fill material and compact so that the area is reasonably smooth and free from irregular surface changes. Next, install wood stakes at the corners of the exterior walls, tie string between the wood stakes six inches above the construction site high point and ensure it is horizontal with a line level. The string may also be run diagonally to each stake to better view the highpoints of the site and make leveling adjustments accordingly.

Figure 1:
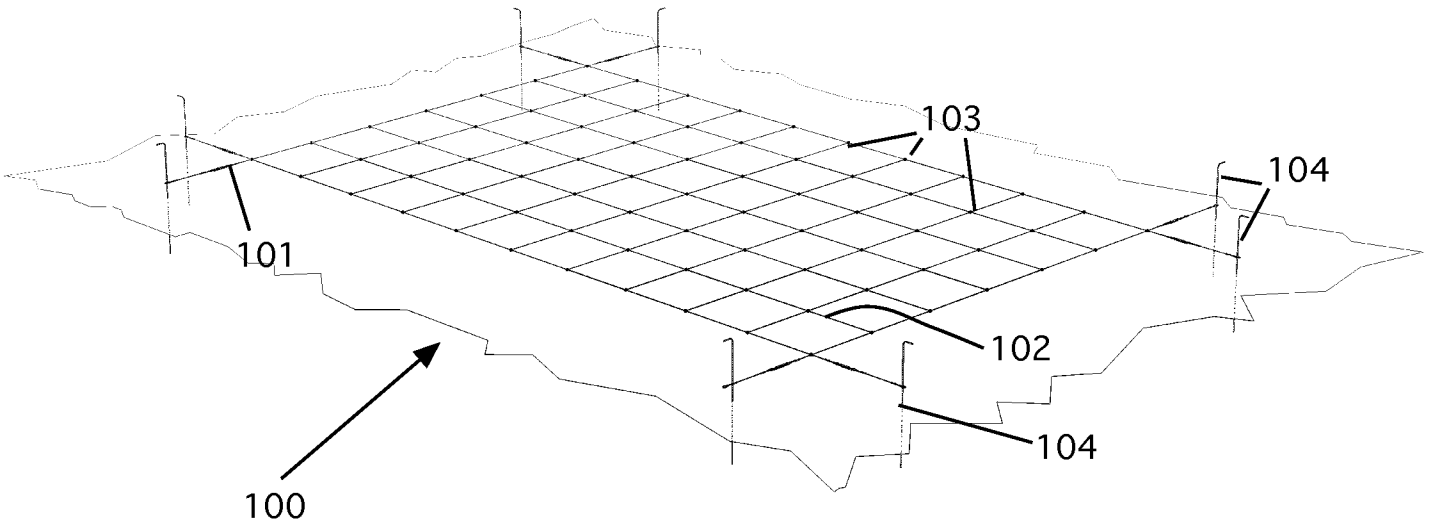
FIG. 1 is a perspective view of a layout grid (LG) used in installing the foundation system.

Once the site is prepared, the next step is to unroll the site layout grid (LG) in the location where the foundation is to be assembled. The assembled grid is shown in FIG. 1. The grid is made up of lengths of coated wire rope. In the preferred embodiment, this is stainless steel vinyl coated wire rope, ⅛" Bare OD, 7/32" Coated OD. The wire rope is cut into sections and secured to end posts.

The grid may be assembled prior to deployment in the field. Note that for the system, the grid 100 has rows 101 and columns 102 of wire rope to make up the grid. The intersections 103 are fitted with special bolts and other hardware called connection nodes, which ensure that the intersections are properly spaced. The foundation poles are placed at these intersections so it is important to make sure they are properly positioned. Once the site is ready the grid is prepared; stretch the grid so that it is flat on the ground. The grid is anchored at the corners with two augers 104 at each of the corners. The augers are installed twelve (12) inches below grade to ensure the wire is taught, and laid directly on grade.

Figure 2:
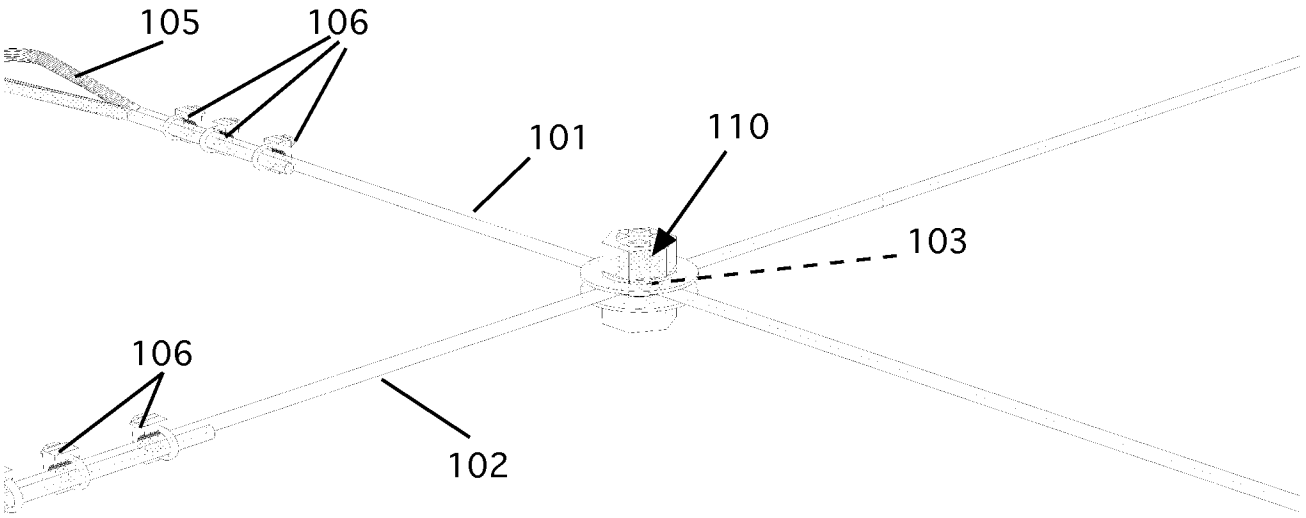
FIG. 2 is a detail view of a connection node bolt (CNB) in the layout grid (LG) of the foundation system.

FIG. 2 shows details of the grid 100 showing one of intersections 103 and the hardware for making up the corners of the rope grid 100. Note that the ends of the rope are folded over to make thimbles 105 using clips 106 in the ordinary manner. The thimbles are placed on all lines leading to each auger. At each of the intersections 103 formed by the rows and columns are bolt assemblies 110 that hold the grid together.

Figure 3:
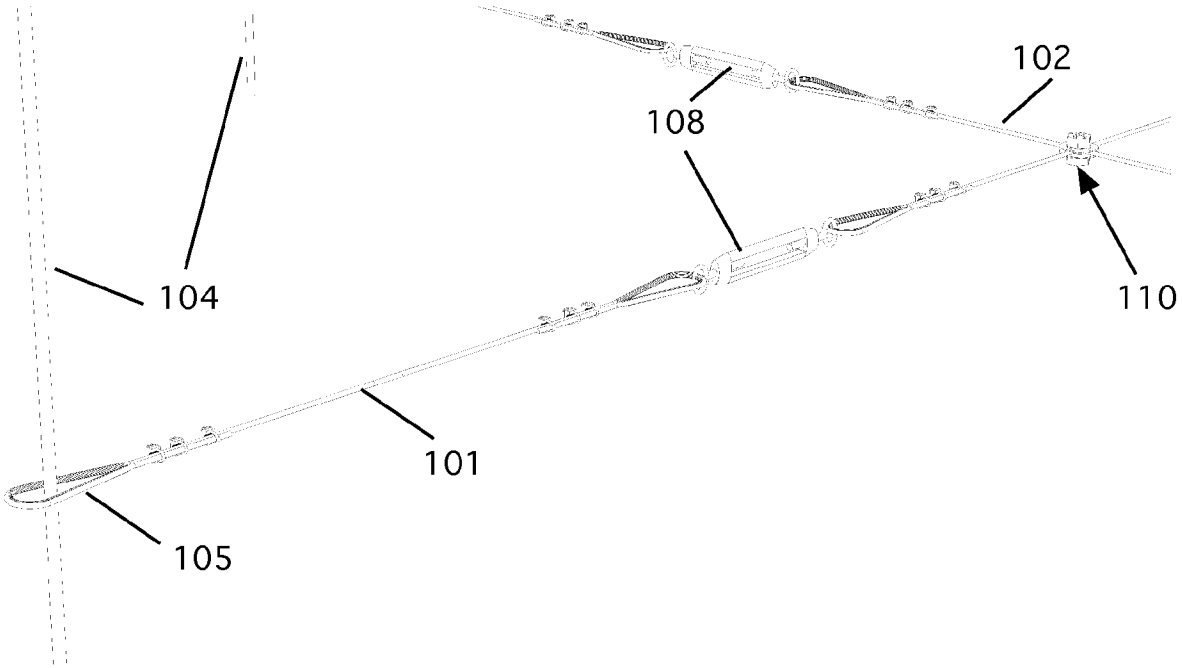
FIG. 3 is a detail view of an auger end post and turnbuckle used in the layout grid (LG) of the foundation system.

FIG. 3 is a detail view of an auger and turnbuckle used in the layout grid (LG) of the foundation system. In this view, the actual attachments are shown. As shown, an auger 104 is shown with a thimble 105 on it. A length of wire rope is run out to a turnbuckle 108. At the other end of the turnbuckle, the main row of the wire rope is attached. This rope runs the width of the foundation area, where it meets another turnbuckle assembly and another auger. The thimbles 105, clips 106 and turnbuckles 108, as a group, can be considered as a means for securing the rows and columns to the plurality of auger posts. Note the bolt assembly 110 at the intersection.

Figure 4:
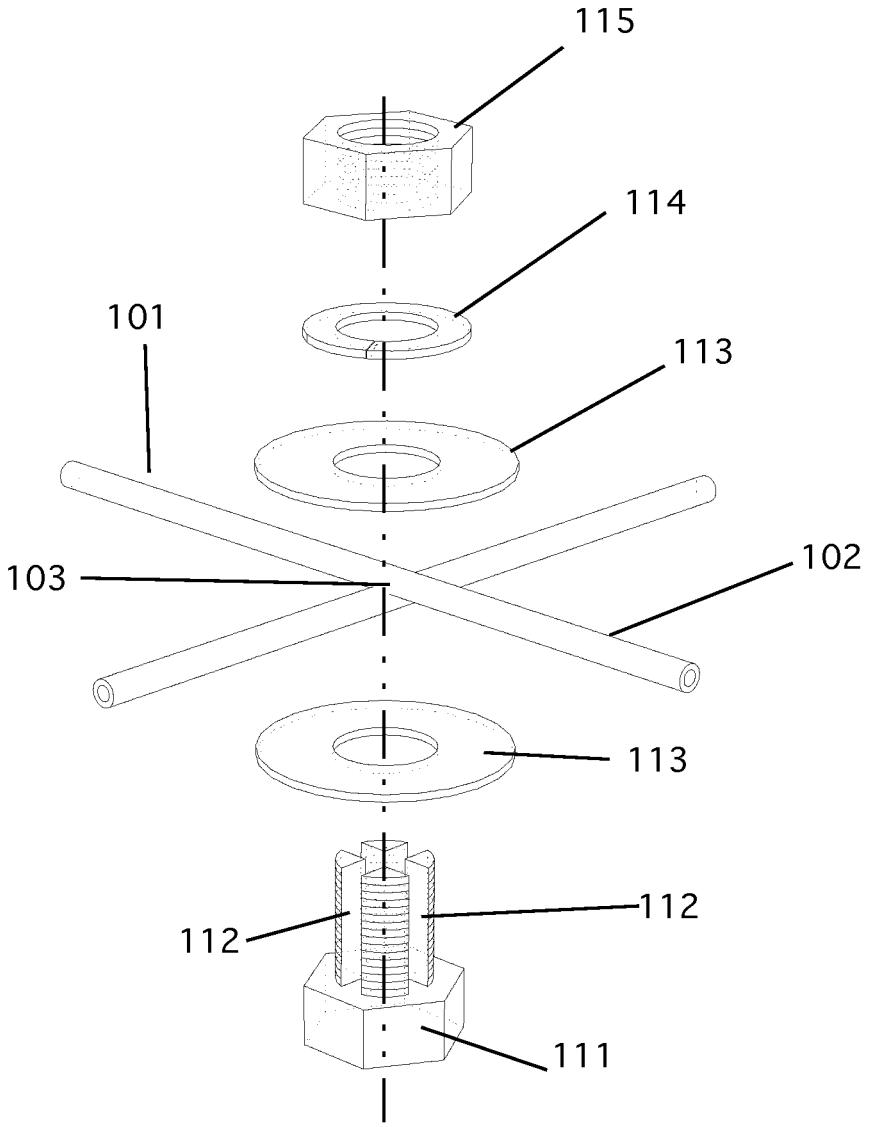
FIG. 4 is an exploded view of the connection node bolt (CNB) used in the layout grid (LG) of the foundation system.

FIG. 4 is an exploded view of the connection node bolt (CNB) assembly 110. At the bottom of the assembly is a ¾"-10 hex bolt 111. This bolt is an ASTM A307 grade A bolts that is zinc plated. Note that it also had two grooves 112 formed in it as shown. These grooves 112 are used to hold the wire ropes that form the grid. The grooves allow the wire ropes 102 and 103 to fit within the bolt to produce a compact assembly. The wire ropes 101 and 102, with the intersection 103, are positioned between two flat washers 113. Above the top washer 113 is a lock washer 114 and hex nut 115 as shown (or hex nylon lock nut replacing lock washer and nut). Note that the bolt and nut assembly described above can be considered as a means for fixing the intersection points. Note also that all of the components discussed above and shown in FIGS. 1-4 can be considered as a "means of forming a grid".

As noted, the grid can be assembled prior to field layout. Once the augers are set and the grid stretched on them and properly tightened, the outline of the wire four-foot grid pattern is transferred using white pavement marking paint (or its equivalent) sprayed onto the surface of the ground. Next, orange color marking flags are installed at all connector node bolt (CNB) locations; i.e., at all four-foot wire spacing's. These flags are pushed deep into the soil so each flag is just visible to avoid pulling out the flag during construction. Once the flags are set, the layout grid (LG) can be rolled up and removed as the site is now prepared for the foundation installation.

This system uses rigid box bar joists (BBJ) set on plies. Unlike conventional pile foundations, however, the piles (called steel tube columns (STC) here) are attached to a leveled set of box bar joists (BBJ) before they are cemented into place. To do this, the following components are used, as shown in the following figures.

Figure 5:
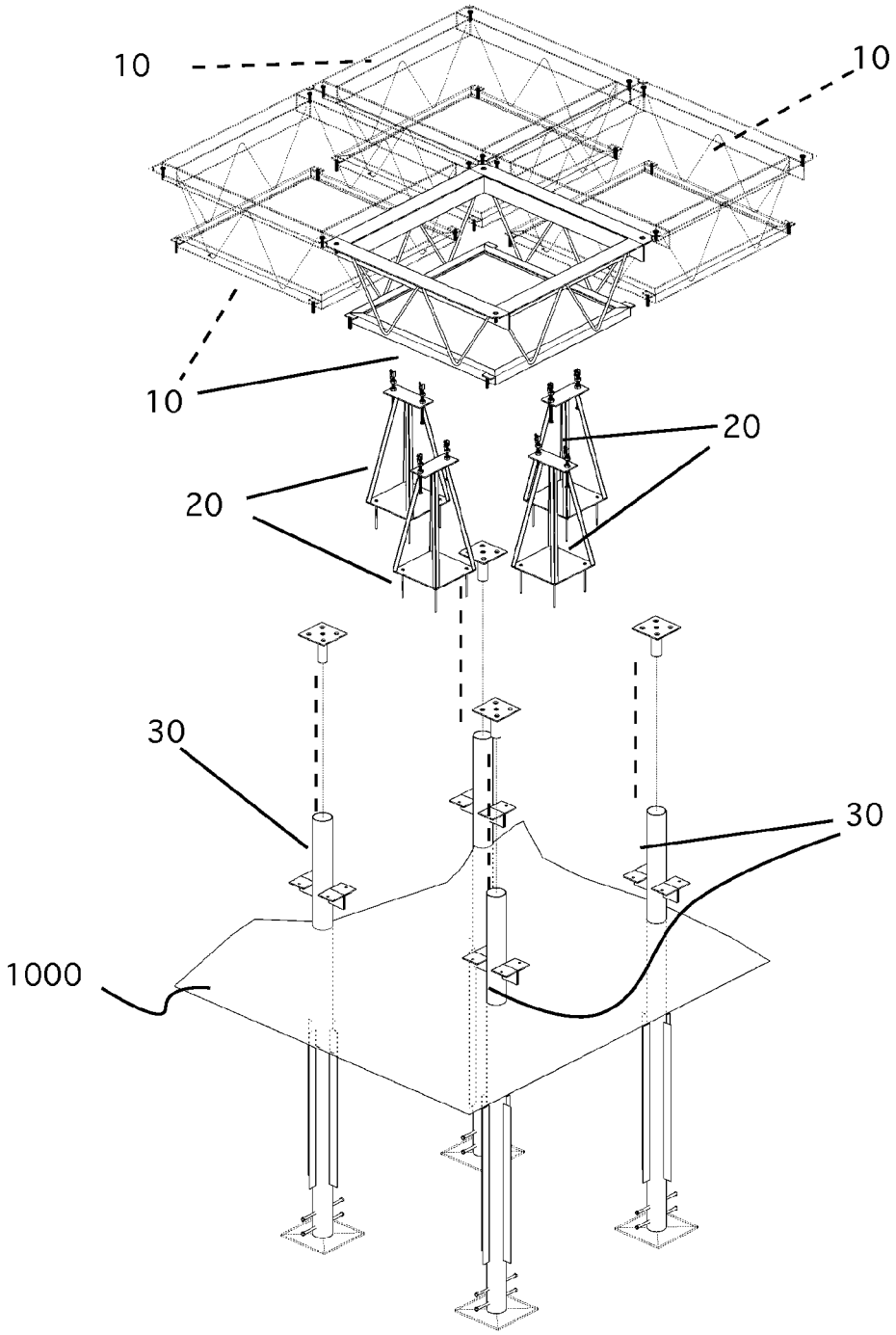
FIG. 5 is an expanded detail view of the major components used in the foundation system.
Figure 6:
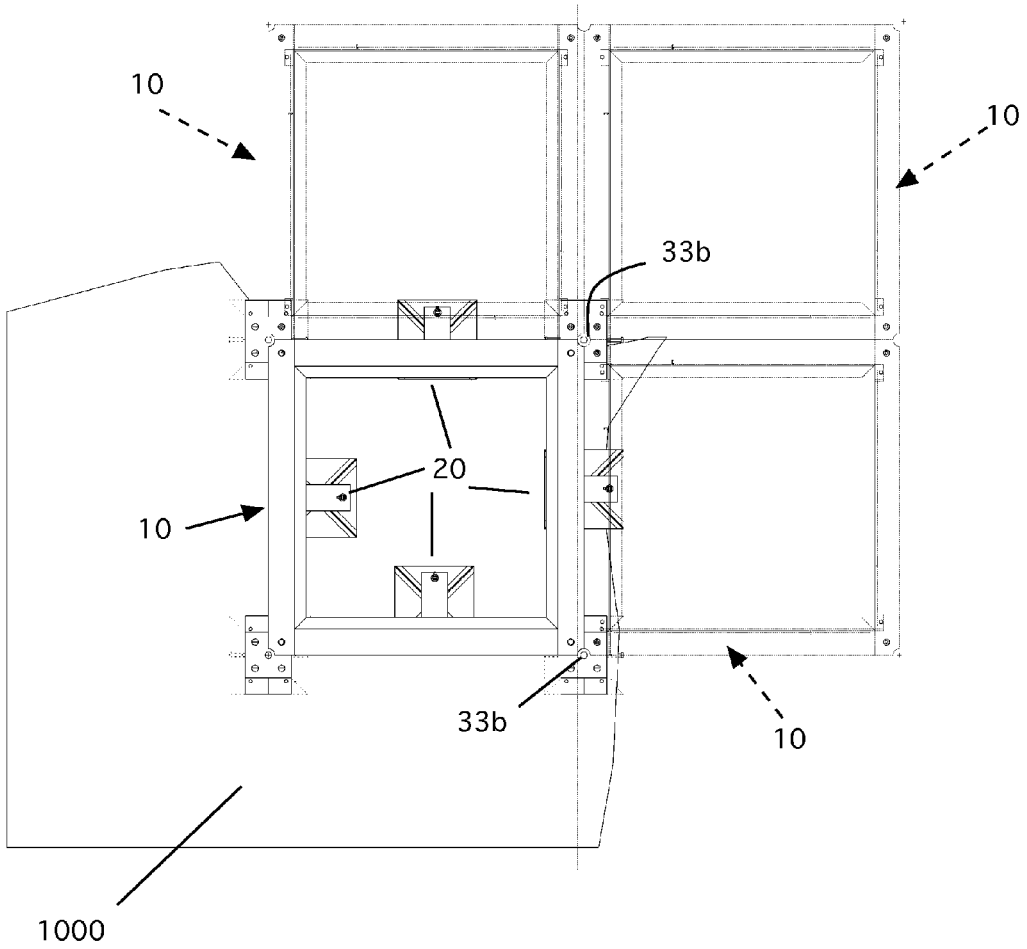
FIG. 6 is a top plan view of a portion of the foundation system.

FIG. 5 is an expanded view of the major components used in the foundation system. FIG. 6 is a top plan view of a portion of the foundation system. At the top of the figure are four box bar joists (BBJ) 10. Below them are four crawlspace leveling lifts (CLL) 20. Below them are four columnar supports called steel tube columns (STC) 30 that are shown embedded in the ground 1000. Note that the steel tube columns (STC) 30, crawlspace leveling lifts (CLL) 20 and box bar joists (BBJ) 10 are the same for a flat site. The installations directions listed below are for a flat site setup. A sloped site setup is the same except that the steel tube columns (STC) are different lengths to accommodate the uneven ground.

Each of the components is discussed in detail below, along with complete installation details.

Figure 7:
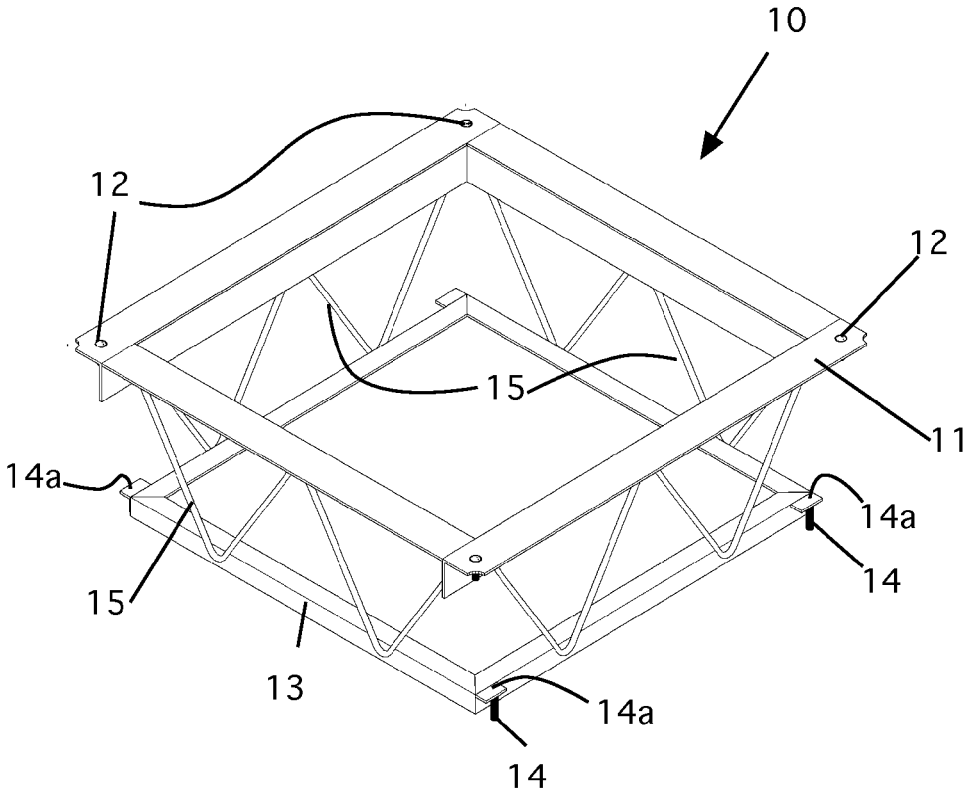
FIG. 7 is a top perspective view of one of the box bar joists (BBJ) used in the foundation system.

FIG. 7 is a top perspective view of one of the box bar joists (BBJ) 10 used in the foundation system. Each BBJ 10 has a top chord 11 that is made up of four pieces of angle iron that are welded together as shown. In the preferred embodiment, each of the top angle iron pieces is a 4" by 4' by 0.25" with two 48" long and two 40" long pieces of angle iron. Four ⅞" inch holes 12 are drilled to receive four ½"-13 bolts 1" long 12*a*, bolt head height is ¼". The bottom chord 13 of the BBJ 10 is made up of smaller angle iron. In the preferred embodiment, the longer frame is made up of four pieces of 2" by 2" by 0.25" by 40½" long angle. Additionally, in the preferred embodiment, four ½"-13 studs 14, 1-inch long are attached as shown to each corner with ¼" steel plate tabs 14*a*. Between the top and bottom chords is a web 15 of #3 rebar, or equivalent, this is welded to the top and bottom chords. Note that the overall height h (see FIGS. 8 and 9) of the BBJ 10 can range from 12 to 30 inches. In the example shown the height h is 18 inches.

Figure 8:
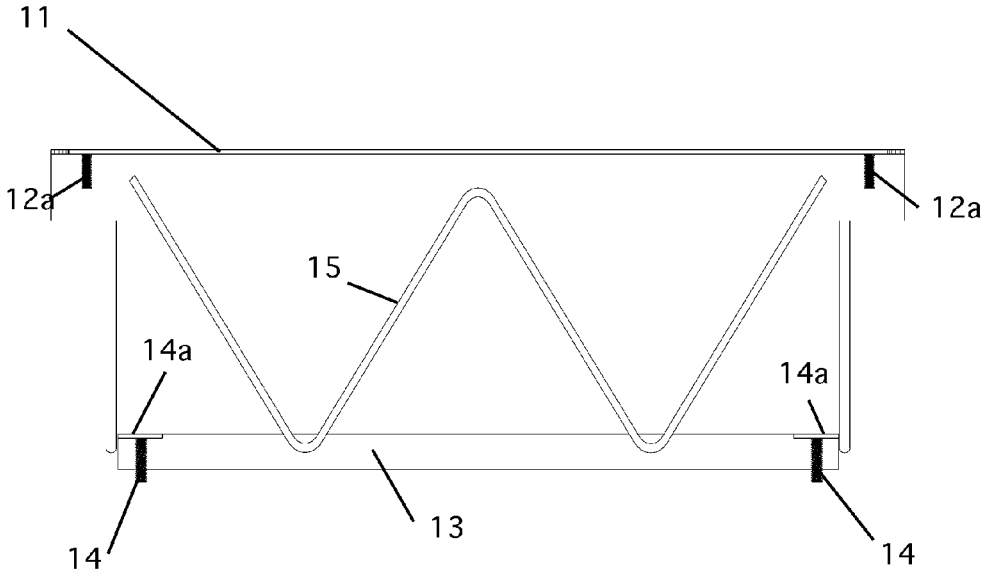
FIG. 8 is a front elevation view of one of the box bar joists (BBJ) used in the foundation system.
Figure 9:
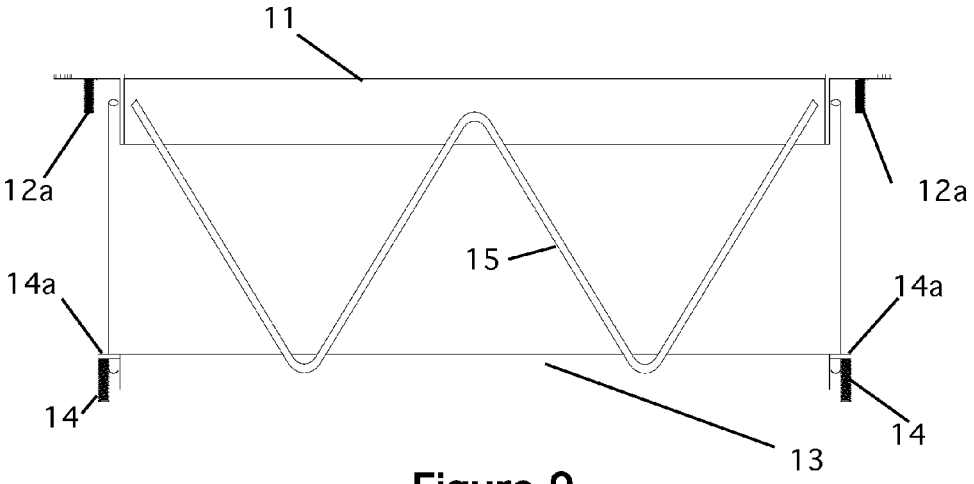
FIG. 9 is a side elevation view of one of the box bar joists (BBJ) used in the foundation system.

FIG. 8 is a front elevation view of one of the box bar joists (BBJ) 10 used in the foundation system. FIG. 9 is a side elevation view of one of the box bar joists (BBJ) used in the foundation system. In these views, the top chord 11, the bottom chord 13 and the web 15 are shown along with the tabs 14*a*, studs 14, ⁄7;8" hole 12, and ½" hex head bolt 12*a*. Note here, the height h is also 18" and overall length of the top chord is 4' and overall length of the bottom cord is 40½" (dimensions may vary per structural calculations).

Figure 10:
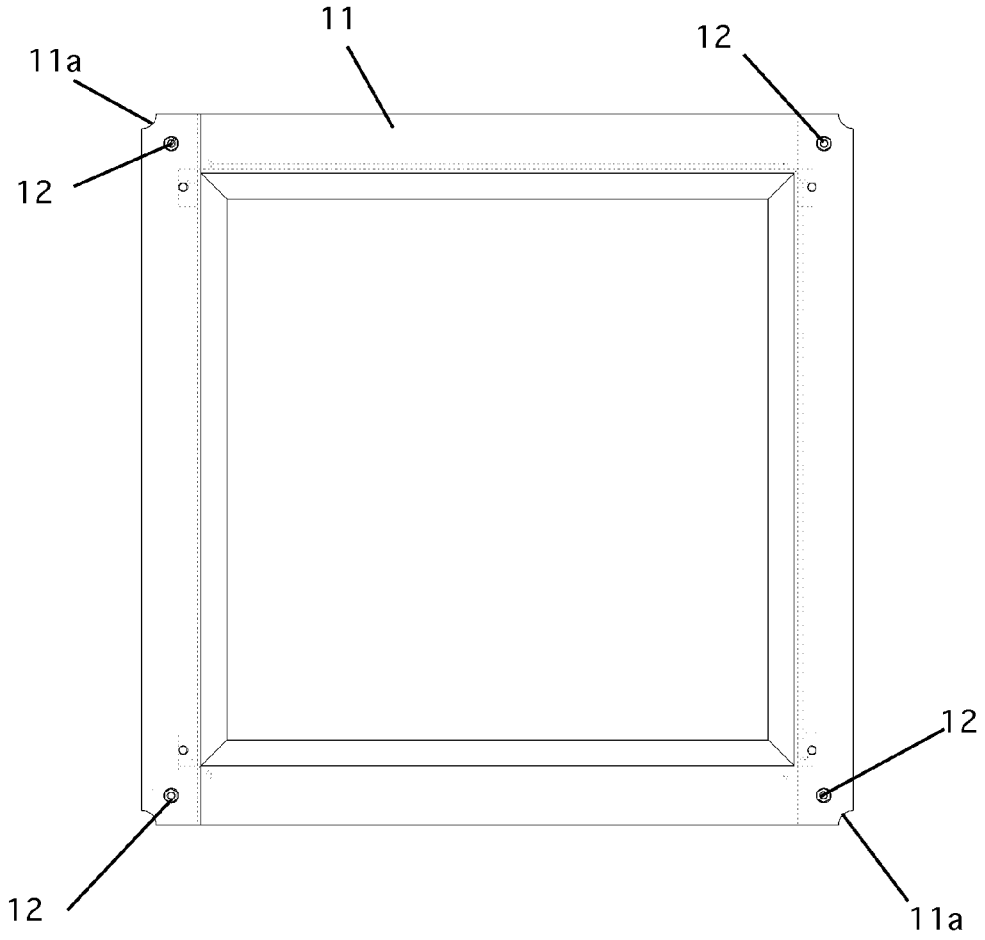
FIG. 10 is a top plan view of one of the box bar joists (BBJ) used in the foundation system.

FIG. 10 is a top plan view of one of the box bar joists (BBJ) used in the foundation system. Here, the top chord 11 is shown. Note that the corners 11*a* are notched. This is to facilitate the assembly, as discussed below. Note here, that the holes 12 and bolts 12*a* are also shown adjacent to the studs 14 and tabs 14*a*.

Figure 11:
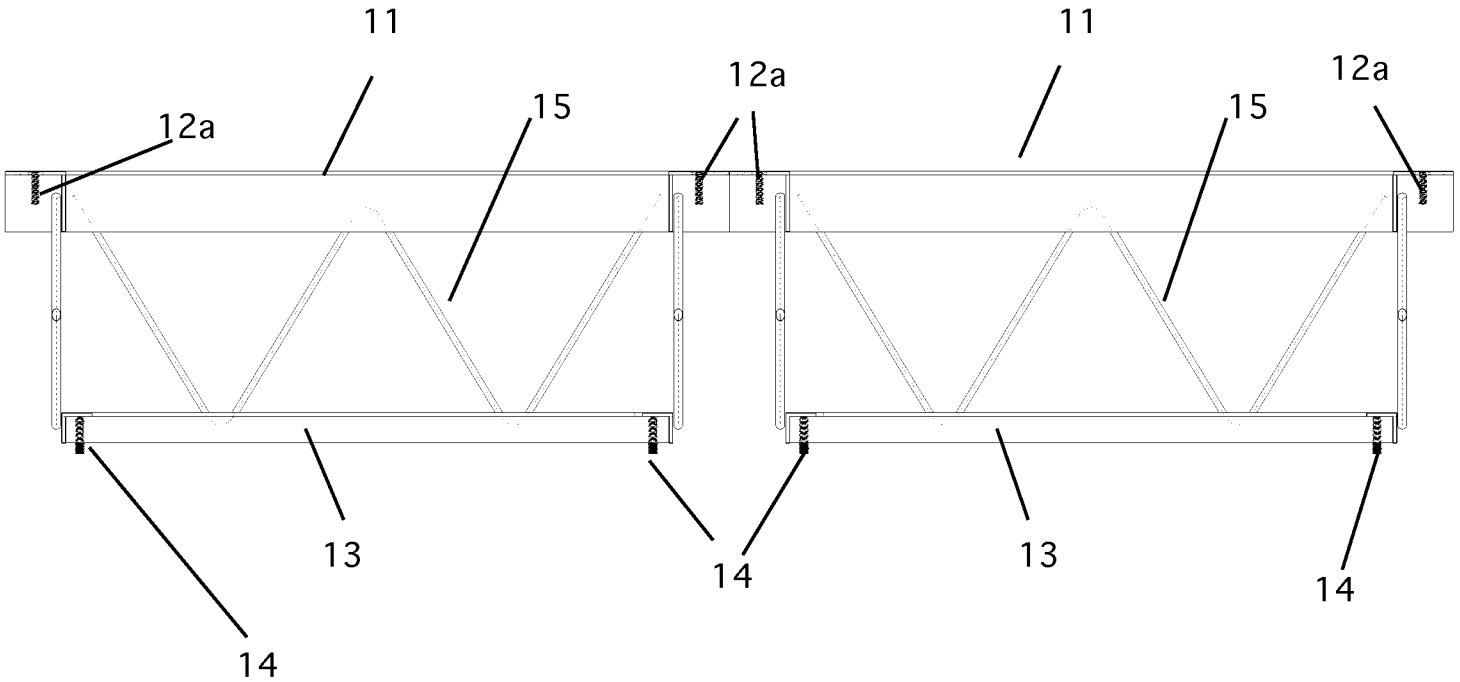
FIG. 11 is a front elevation view of two box bar joists (BBJ) used in the foundation system.
Figure 12:
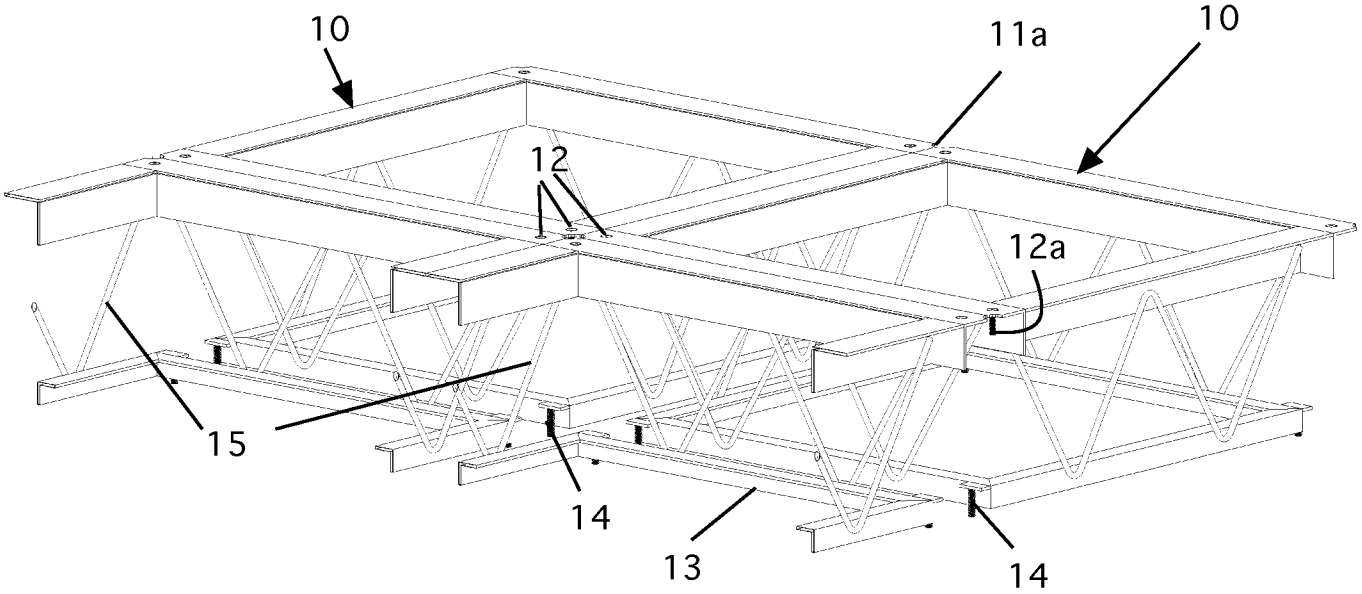
FIG. 12 is a perspective detail section view of an alignment of 4 box bar joists (BBJ) used in the foundation system.

FIG. 11 is a front elevation view of two box bar joists (BBJ) used in the foundation system. Here, two sections of BBJ 10 are shown placed adjacent. This is how the BBJs are aligned during the construction. FIG. 12 is a perspective detail section view of an alignment of four BBJs used in the foundation system. In this view, note how the holes 12 and the studs 14 are aligned. Note too, that the notched corners 11*a* come together to form a hole in the center of the assembled BBJs, as shown. This hole is used to secure the aligning bar connectors (ABC), as described below. All BBJs are galvanized and are coated with a bitumen coating.

Figure 13:
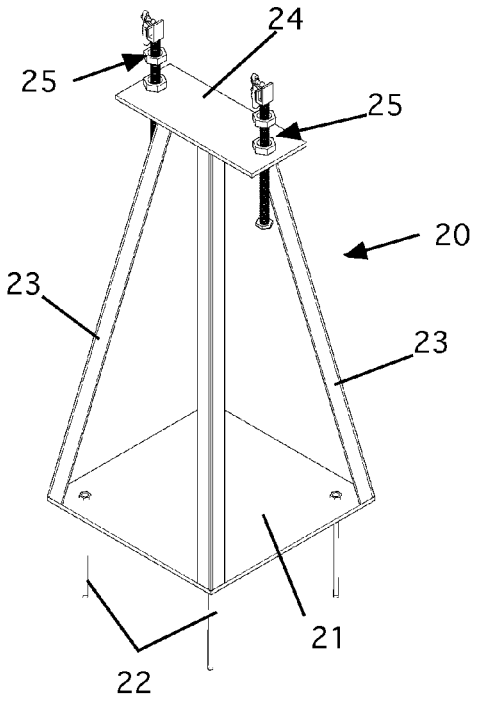
FIG. 13 is a top perspective view of one of the foundation crawlspace leveling lifts (CLL) used in installing the foundation system.
Figure 14:
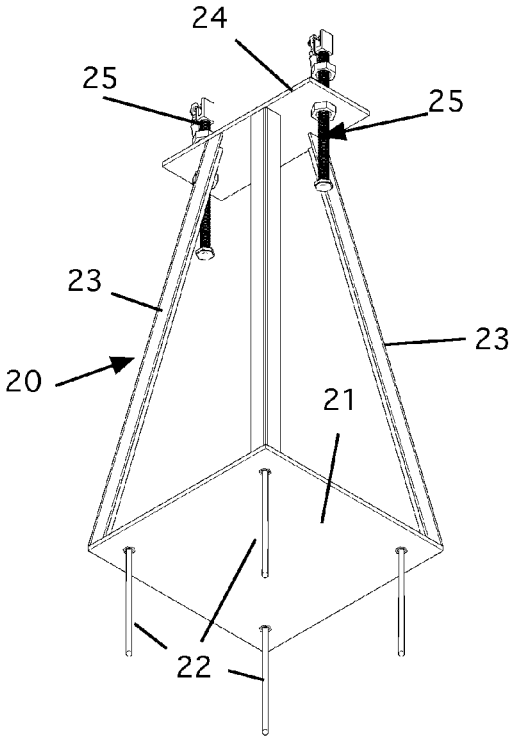
FIG. 14 is a bottom perspective view of one of the foundation crawlspace leveling lifts (CLL) used in installing the foundation system.

As discussed above, the BBJs 10 must be arranged and leveled prior to attaching the steel tube columns (STC). To do this, a number of crawlspace leveling lifts (CLLs) 20 are used to support and level the BBJs. These CLLs can be considered as a means for temporarily supporting the box bar joints. Referring now to FIGS. 13-16, details of the crawlspace leveling lifts (CLLs) 20 are shown. FIG. 13 is a top perspective view of one of the foundation crawlspace leveling lifts (CLL) 20 used in installing the foundation system. FIG. 14 is a bottom perspective view of one of the foundation crawlspace leveling lifts (CLL) used in installing the foundation system. Each of the CLLs 20 consists of a base plate 21 that has four spikes 22 attach that extend downwardly from the base plate 21 as shown. Four angle braces 23 extend upward from the base plate (one is placed at each corner of the base plate). The braces 23 are attached to a top plate 24 as shown. Two leveling toggle bolts (LTB) 25 assemblies, which can be considered as a means for leveling the box bar joints, are attached to the top plate as shown.

Figure 15:
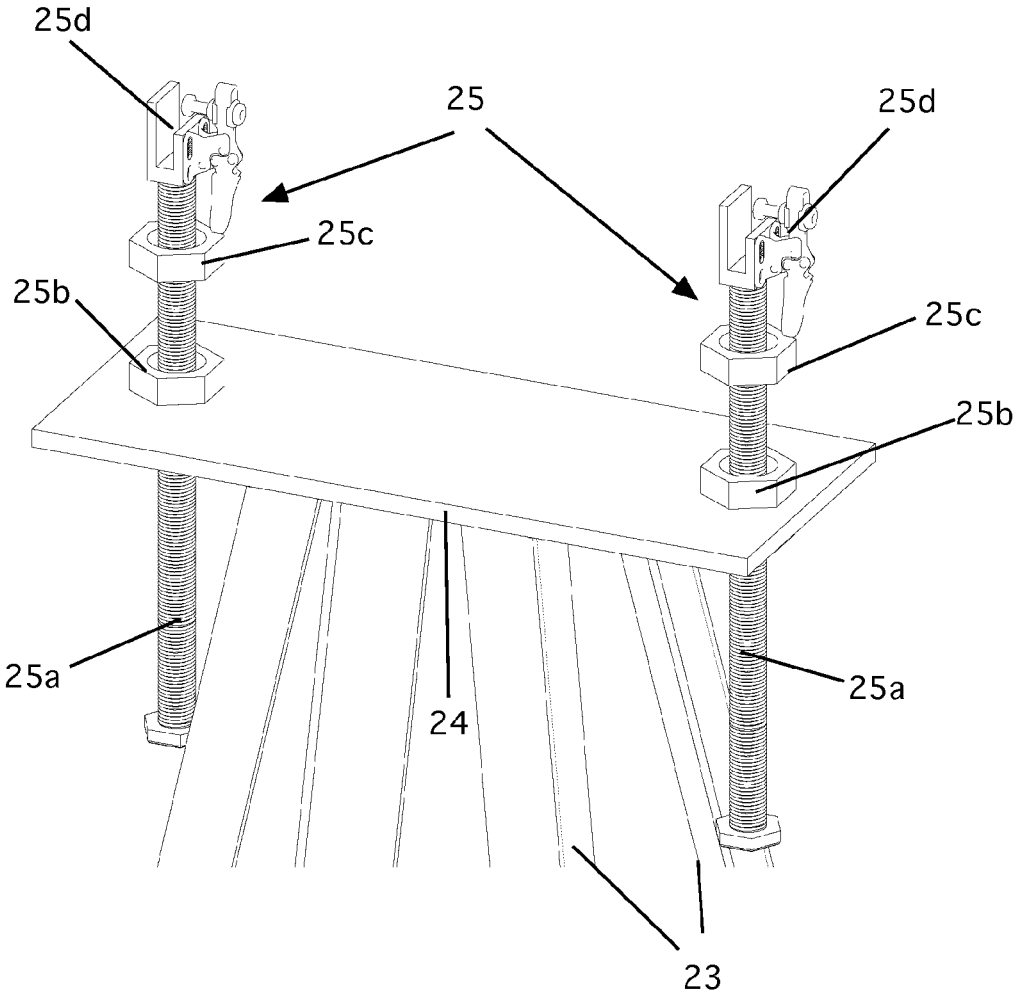
FIG. 15 is an enlarged detail view of the leveling toggle bolts (LTB) on one of the foundation crawlspace leveling lifts (CLL) used in installing the foundation system.
Figure 16:
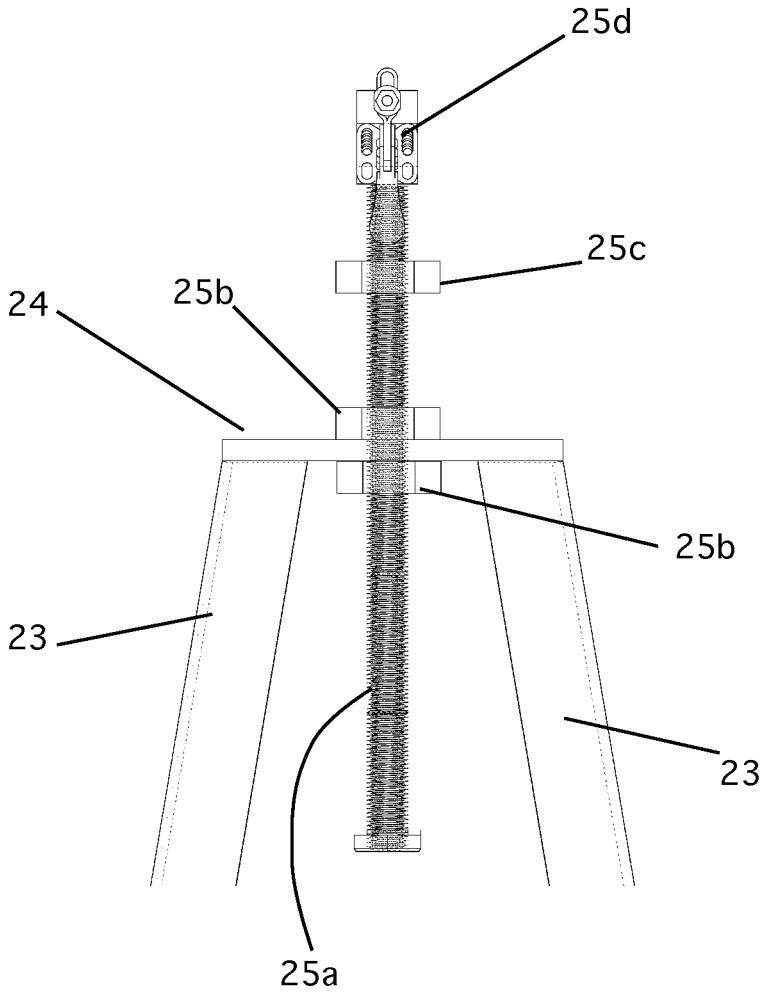
FIG. 16 is an enlarged side view of one of the leveling toggle bolts (LTB) on one of the foundation crawlspace leveling lifts (CLL) used in installing the foundation system.
Figure 17:
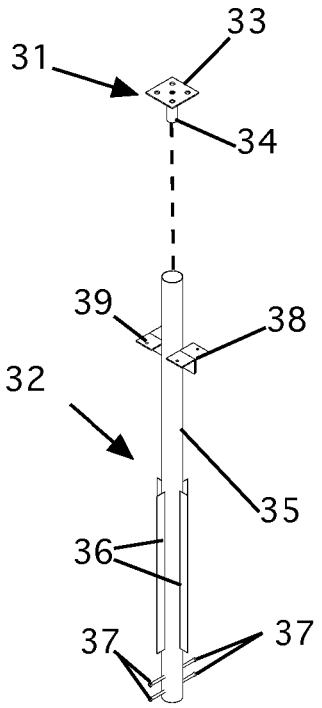
FIG. 17 is a perspective view of one of the steel tube columns (STC) used in the foundation system.
Figure 18:
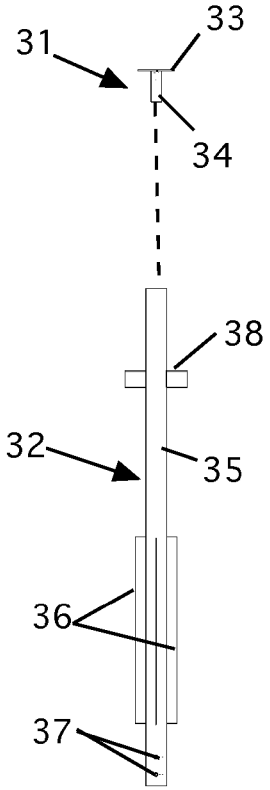
FIG. 18 is a side elevation view of one of the steel tube columns (STC) used in the foundation system.
Figure 19:
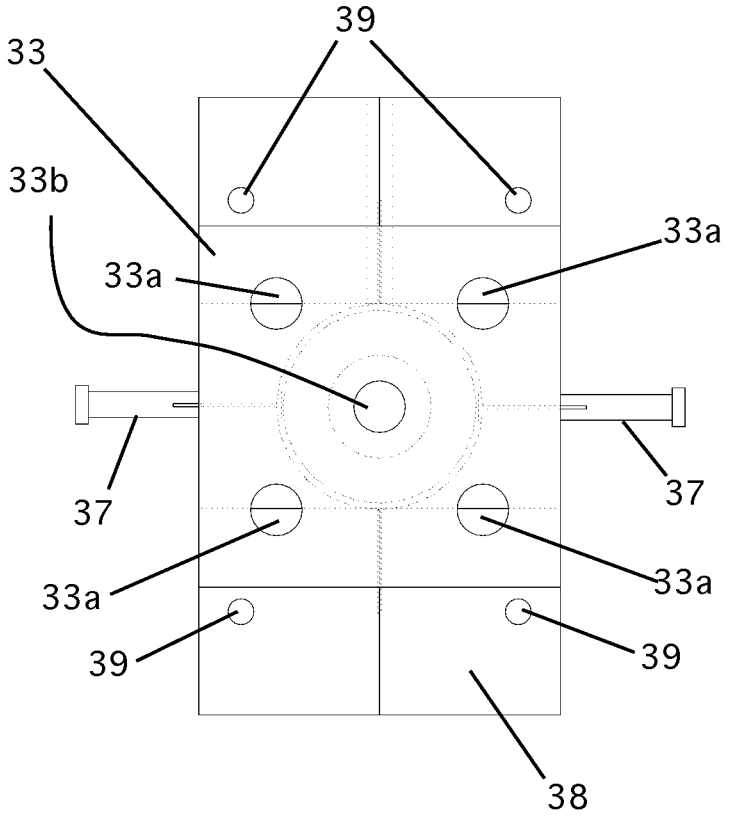
FIG. 19 is a top detail view of one of the steel tube columns (STC) used in the foundation system.

FIG. 15 is an enlarged detail view of the leveling toggle bolt assemblies 25 on one of the foundation crawlspace leveling lifts. FIG. 16 is an enlarged side view of one of the leveling toggle bolt assemblies. These assemblies are temporarily installed, as described below, and are used to level the BBJs and to support the BBJs and the STCs while the concrete for the STCs is curing. Each leveling toggle bolt assembly 25 has a long bolt 25*a* that is threaded through two nuts 25*b* that are welded to the top plate 24 as shown. A leveling nut 25*c* welded and fixed to the bolt is provided as a measuring device to move bolt 25*a* to the desired height, as discussed below. At the top of each of the toggle bolts 25*a* is a "C" holder and toggle clamp 25*d* that is riveted (and free turning) to the top of the bolt 25*a*. In use, the bottom frame angle of a BBJ is placed in the "C" holder of the toggle bolt and clamped into place. Then, the toggle bolt height can be adjusted as needed, as described in the installation section below. Referring now to FIGS. 17-19, details of the steel tube columns (STC) 30 are disclosed. FIG. 17 is a top perspective view of one of the steel tube columns (STC) used in the foundation system. FIG. 18 is a side elevation view of one of the steel tube columns (STC) used in the foundation system. Each STC 30 consists of a top cap 31 and a lower column 32. The top cap gas a 7" square× ¼" thick flange 33 that is secured to a 6" long, 2½ inch OD round bar 34. In the preferred embodiment, the cap is galvanized; the top cap secures the BBJs top chord hex bolt 12*a*. Below the cap is a lower column 32. This column is a 3" diameter steel tube 35,/3;16" thick and is between 6 and 8 feet long. In the preferred embodiment it is galvanized and covered with a bitumen covering. The column has four ¼"×2"×2' hurricane fins 36 attached as shown. Below the fins, four 2" shear studs 37 are attached. Two steel angles 38, 3"×3"0.25", 4" long are attached on opposite sides of the column. These angles have 9⁄16" diameter holes 39 drilled in them (see also FIG. 19). The angles secure the BBJs stud 14, tighten with a ½" hex net and washer.

FIG. 19 is a top detail view of one of the steel tube columns (STC) used in the foundation system. Here, the top cap 31 is shown. Note that the top cap has four 9⁄16" perimeter holes 33*a* formed in it as shown, and a center hole 33*b* that is tapped at 1"-12 NC threads, 2" deep. The cap 31 is placed into the lower column 32 and is welded to the lower column assembly.

Figure 20:
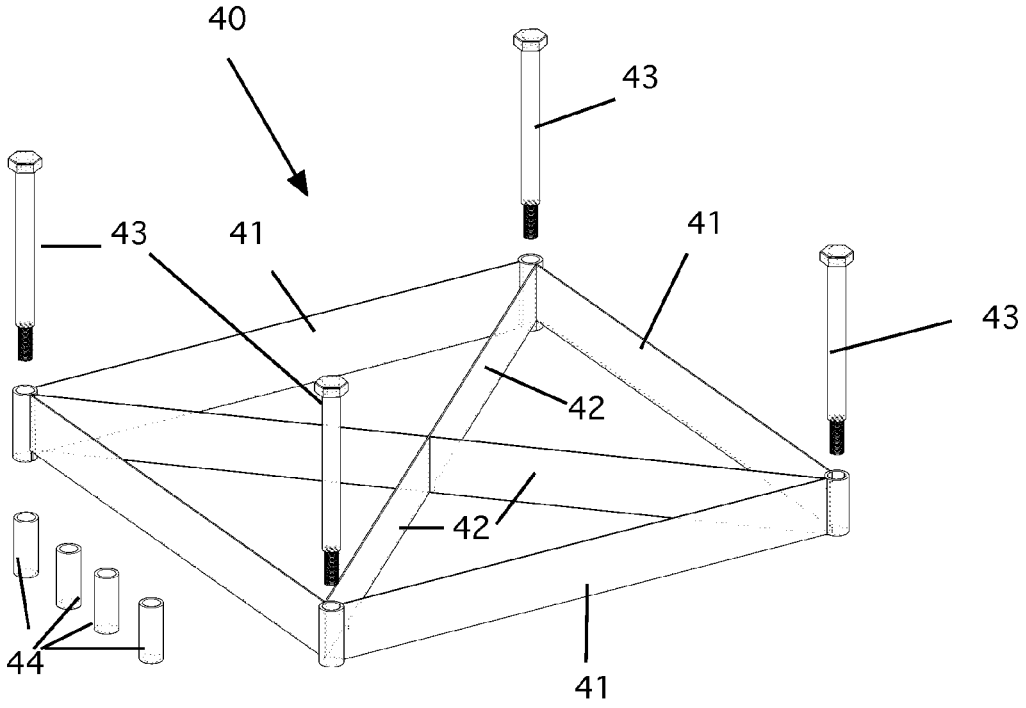
FIG. 20 is a perspective view of the components used as part of the aligning bar connector (ABC) system.
Figure 21:
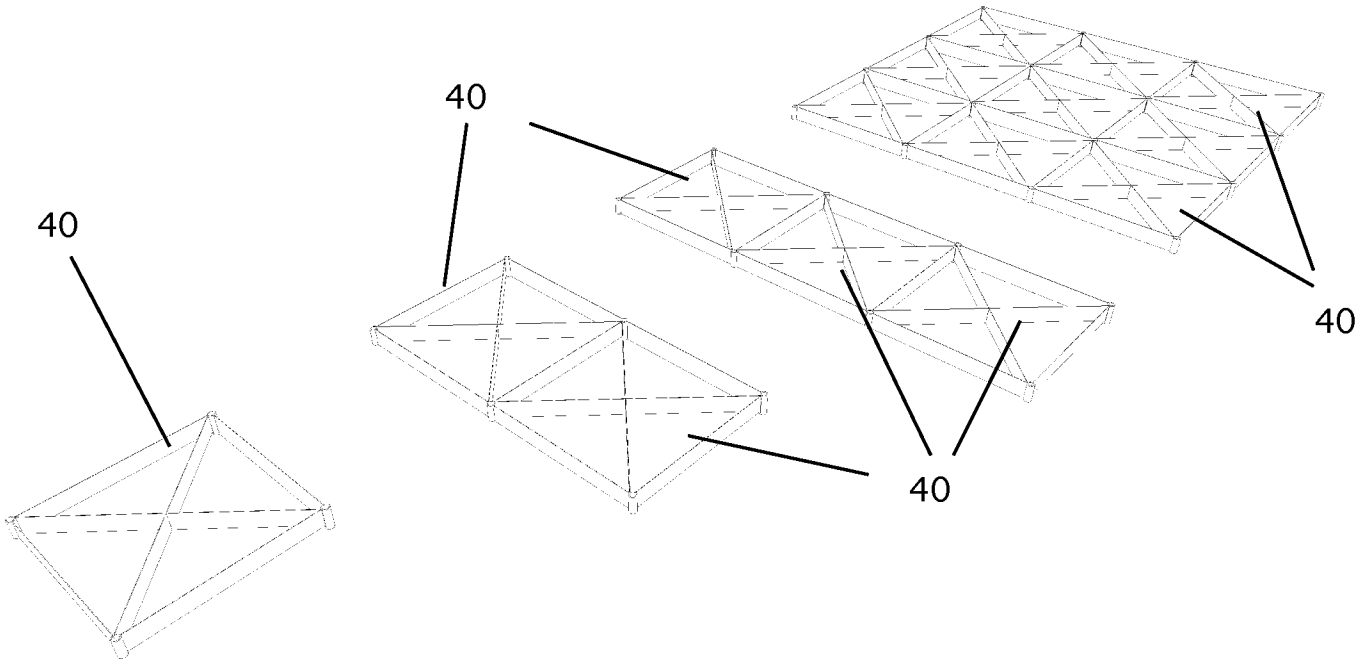
FIG. 21 is a detail perspective view of the various aligning bar connector (ABC) systems.

Finally, another temporary component is shown on FIGS. 20 and 21. FIG. 20 is a perspective view of the components used as part of the aligning bar connector (ABC) system. The aligning bar connectors (ABCs) 40 are made up of ⅛" steel plates 41 that from a square perimeter and are reinforced by plates 42 that cross in the center as shown. At the four corners are steel tubes 42, 1½ inch (nominal) milled ID, as shown. Four 1½ inch shoulder bolts 43 are placed in the tubes 42. In addition, a number of spacers 44, made from 2" round stock and having 1½ inch (nominal) milled holes are used to support the ABCs when installed to the steel tube columns (STC) aligning them to the modular grid system.

FIG. 21 is a detail perspective view of various aligning bar connectors (ABC) to be used to align the steel tube columns (STCs). In this view, a single ABC is overlaid with 2 ABCs, followed by three, and so on. The ABCs 40 provide a locking overlay to secure all of the foundation components from above as part of the curing process, as discussed below. In practice, referring to FIG. 6, the first ABC is placed atop the first BBJ. The four shoulder bolts are then secured to the center holes 33*b* on the top caps. Once this is done, the second ABC is secured to the adjacent BBJ. Note that this ABC overlaps the first at one edge. Thus, two of the bolts used in the first installation are removed and then fed through the steel tubes 42 on both of the ABCs. Obviously, spacers 43 are used to support the other end of the second ABC. In a similar manner additional ABCs are installed overlapping them as needed until the entire foundation is covered.

To install the foundation, the following steps are used:

First, set up a laser level at a far corner of the grid that has been laid out as described above. Ensure the laser level is placed in an unobstructed sight line of all marking flags. This corner is opposite of where the first BBJ 10 is to be placed. The start location may be at any corner. In the preferred embodiment, the laser level height is 27" above grade.

Next, the grid area is inspected to remove debris, vegetation, large rocks and tripping hazards. All paint markings and marking flags are verified as being visible. Note that as described above, the marking flags and paint stripes are on a four (4) foot grid.

Beginning with the first grid square, (opposite diagonal end from laser) auger two rows of STC holes (Depth varies per location). These holes should start at the short length of the building and next row over.

Next, tamp down and compact the exposed earth at the bottom of each hole. Then pour 1 cubic foot of crushed rock into the hole and tamp and compact the rock.

Once the rock has been compacted, place a paver (stone or plastic) cover over each hole. In this example, these holes are called row one (1) and two (2).

Next, place four CLLs 20 in the starting corner of the grid (herein called square #1). As shown in FIG. 6, place each of the CLLs centered between the holes drilled for the STCs around the perimeter of the first starting corner square #1.

Place the perimeter CLLs 20 with the screw hold up toggle lock bracket on the inside of the square (one toggle lock will be unused at the perimeter, as shown in FIG. 6).

Note, the bottom plate stakes are not pushed into soil more than an inch at this time. Place a BBJ 10 on the first square CLLs 20 into the channel next to the toggle bolt clamps again as shown in FIG. 6. Ensure that the CLLs are in a near vertical position. Then, the bottom plate stakes are hammered into the ground.

Next, the leveling/toggle bolts are adjusted (up or down) until the welded leveling nut is centered in the laser level beam. (Note: in the preferred embodiment, the leveling nut is welded to the leveling/toggle bolt.

These steps are repeated for each CCL. When first CCL is level (i.e., when all leveling nuts at the same height), this is the height of all the BBJs 10 used in the system.

Next, after ensuring that the laser level is perfectly level at all times, begin working in the second grid square. As before, the next three CLLs are placed in the adjacent grid square. Similarly, the next BBJ is placed atop the three new CLLs, next to the installed BBJ.

Next, an STC 30 is placed in each of the four holes at square #1. (Note: STC may need to be placed earlier, depending on depth of hole from structural analysis). Each STC is raised up and the column cap is bolted to the BBJ hand tight. See FIG. 6 for the position of these components. Next four STC are installed in the grid square #2, as before.

Next, an aligning bar connector (ABC) is bolted into the center of each column cap 33*a*. See FIG. 6. Next, the bolts on the column cap are wrench tightened on each BBJ. Then concrete is poured into each STC hole.

The remaining grid squares for the foundation assembly are completed using the same process as in grid squares #1 and #2.

After seven (7) days from the last concrete pour, the CLLs are removed, and earth is pushed back into the holes in eight-inch lifts. Leach lift is compacted. Compact a small amount of earth two inches high around the top of each STC hole.

At this point, the foundation system is complete and ready for building upon.

Note that the ABCs are not removed at this time. They are removed only when floor joists assemblies (FJA not part of this system) are installed. Note: an alternate method of construction uses floor joists assemblies (FJA) in place of the ABCs.

Finally, a crawlspace vapor barrier may be installed later in the construction process, for example, after installation of roofing.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A modular structure foundation system comprising a) a plurality of box bar joists, each box bar joist having a square upper frame having an outer perimeter and a completely open center portion, a square lower frame also having an outer perimeter a completely open center portion and a web support structure extending upwardly from the outer perimeter of said square lower frame and terminating upon said outer perimeter of square upper frame, therebetween each of said box bar joists also having four corners;

b) a plurality of columnar supports, attached to said box bar joists and extending downward therefrom into a ground surface; and c) a means of forming a temporary grid on said ground surface, said grid having a plurality of rows and columns running orthogonally creating a plurality of intersections between said plurality of rows and plurality of columns designated as nodes.

2. The modular structure foundation system of claim 1 wherein each of said nodes has a vertical hole formed in ground surface.

3. The modular structure foundation system of claim 1 further comprising a means for temporarily supporting said plurality of box bar joists above said ground surface.

4. The modular structure foundation system of claim 3 wherein the means for temporarily supporting said plurality of box bar joists further includes a means for leveling said plurality of box bar joists.

5. The modular structure foundation system of claim 4 wherein the means for temporarily supporting said plurality of box bar joists comprises:

a) a base plate having at least one spike extending downwardly therefrom;

b) at least two angle braces extend upward from the base plate c) a top plate, attached to said at least two angle braces; and d) two leveling toggle bolts assemblies attached to the top plate.

6. The modular structure foundation system of claim 5, wherein the two toggle bolt assemblies each comprise:

a) a long bolt having a plurality of threads;

b) a pair of nuts, secured to said top plate and further wherein said long bolt is threadably secured in said pair of nuts;

c) a locking nut threadably attached to said long bolt;

d) a "C" holder attached to said long bolt; and e) a toggle clamp attached to said "C" holder.

7. The modular structure foundation system of claim 1 wherein the columnar supports further comprise:

a) a top cap having an upper flange and a lower member, extending downwardly from said upper flange; and b) a lower column.

8. The modular structure foundation system of claim 7 wherein the lower column further comprises:

a) a vertical member having a hollow interior to receive the lower member of said top cap;

b) at least one hurricane fin attached to said vertical member;

c) at least one shear stud attached to said vertical member and extending outwardly therefrom; and d) at least one steel angle member attached to said vertical member and extending outwardly therefrom.

9. The modular structure foundation system of claim 8 wherein the top cap further comprises an upper flange having four perimeter holes and a center hole formed therein.

10. The modular structure foundation system of claim 1 wherein the means of forming a grid on site comprises:

a) a plurality of rows and columns made of wire rope positioned orthogonally with respect to each other such that when a row crosses a column, an intersection point is formed; and b) a means for fixing the intersection points on said grid such that the relative positions of said intersection points remains constant.

11. The modular structure foundation system of claim 10 wherein the means for fixing the intersection points comprise:

a) a plurality of bolts, each of said plurality of bolts having two grooves, orthogonally formed therein, whereby a row and a column of wire rope are secured in said two grooves; and b) a nut, for securing said bolt to said row and column at one of said intersection points.

12. The modular structure foundation system of claim 10 further comprising:

a) a plurality of augers posts installed in said ground surface about a perimeter of a foundation site; and b) a means for securing said rows and columns to said plurality of auger posts.

13. The modular structure foundation system of claim 12 further comprising a plurality of turnbuckles, one of said plurality of turnbuckles being to each row of wire rope and to each column of wire rope.

14. The modular structure foundation system of claim 1 further comprising:

a) an aligning bar connector system temporarily attached to said plurality of box bar joists.

15. The modular structure foundation system of claim 14 wherein the aligning bar connector system includes:

a) a plurality of aligning bar connectors each aligning bar connector having a square frame, having four corners, and a pair of center braces formed therein; and b) four tubes, one of said four tubes being attached to each of said four corners of said square frame.

16. The modular structure foundation system of claim 15 wherein the aligning bar connector system further includes:

a) four shoulder bolts, one of said four shoulder bolts being removably installed in each of said four tubes; and b) a plurality of spacers, applied to said four shoulder bolts to adjust the position of each of said four corners of said square frame to a level position.

* * * * *